US006808046B1

(12) United States Patent
Henson

(10) Patent No.: US 6,808,046 B1
(45) Date of Patent: Oct. 26, 2004

(54) BODY HARNESS

(75) Inventor: William E. Henson, Otter Lake, MI (US)

(73) Assignee: American Escape Systems, Inc., Rochester Hills, MI (US)

( * ) Notice: Subject to any disclaimer, the term of this patent is extended or adjusted under 35 U.S.C. 154(b) by 0 days.

(21) Appl. No.: 10/281,639

(22) Filed: Oct. 28, 2002

(51) Int. Cl.[7] ..... A47L 3/04
(52) U.S. Cl. ..... 182/3; 182/5; 182/7; 244/151 R
(58) Field of Search ..... 182/3, 4, 5, 6, 182/7, 8, 9, 65.1, 133, 134, 135, 136; 119/96, 857; 244/151 R

(56) References Cited

U.S. PATENT DOCUMENTS

| | | | | |
|---|---|---|---|---|
| 634,604 | A | * 10/1899 | Asche | 182/3 |
| 3,424,134 | A | 1/1969 | Rosenblum | |
| 4,553,633 | A | * 11/1985 | Armstrong et al. | 182/3 |
| 4,712,513 | A | * 12/1987 | Huppertsberg | 182/3 X |
| 4,854,418 | A | * 8/1989 | Hengstenberger et al. | 182/3 |
| 5,203,829 | A | * 4/1993 | Fisk et al. | 182/3 X |
| 5,205,450 | A | * 4/1993 | Derosier | 224/161 |
| 5,220,976 | A | * 6/1993 | Gunter | 182/3 |
| 5,329,884 | A | 7/1994 | Bell | |
| 5,360,082 | A | * 11/1994 | Bell | 182/3 |
| 5,516,233 | A | * 5/1996 | Courtney | 405/186 |
| 6,155,384 | A | * 12/2000 | Paglioli | 188/65.2 |
| 6,233,740 | B1 | * 5/2001 | Meyers et al. | 119/857 X |
| RE37,394 | E | * 10/2001 | Woodyard | 182/3 X |
| 6,367,582 | B1 | 4/2002 | Derby | |
| 6,371,244 | B2 | * 4/2002 | Okamura | 182/72 |
| 2002/0084139 | A1 | * 7/2002 | Richard et al. | 182/5 |
| 2002/0113103 | A1 | * 8/2002 | O'Hare | 224/155 |
| 2002/0148681 | A1 | * 10/2002 | Sharp | 182/3 |
| 2002/0158098 | A1 | * 10/2002 | Price | 224/674 |
| 2003/0010567 | A1 | * 1/2003 | Gayetty | 182/3 |
| 2003/0062218 | A1 | * 4/2003 | Zeissler et al. | 182/3 |

FOREIGN PATENT DOCUMENTS

| | | | |
|---|---|---|---|
| GB | 2074010 | * 10/1981 | 182/3 X |

* cited by examiner

*Primary Examiner*—Bruce A. Lev
(74) *Attorney, Agent, or Firm*—Alex Rhodes

(57) ABSTRACT

An improved body harness for use during an emergency and for fire fighters, tree trimmers, window washers, mountain climbers and construction workers. A pocket is provided on the front of the harness for enclosing either a descender and/or a lifeline. The pocket is capable of withstanding the forces of the descender during a lowering of a person wearing the harness from a height to a relatively lower height. An aperture is provided in an upper portion of the harness for installing the harness over a head of the person. Three buckles are used for installing the harness on a person. The body harness is moderate in cost, easy to install and requires only a small amount of storage space when the harness is not in use.

10 Claims, 4 Drawing Sheets

BODY HARNESS

FIELD OF THE INVENTION

This invention relates to harnesses and more particularly to a body harness which is used to rescue persons from heights and as a safety harness of fire fighters, tree trimmers, window washers, mountain climbers and construction workers.

BACKGROUND OF THE INVENTION

Body harnesses for lowering persons from a height to a relatively lower height are exemplified in the prior art by U.S. Pat. Nos. 6,367,582; 3,424,134; and 5,329,884. The reference patents disclose bulky, complex structures consisting of shoulder straps, leg straps, belts, buckles, "D" rings and similar connectors for attaching descenders and lifelines. Shoulder belts are often interconnected by chest straps and buckles. The shoulder straps, leg straps and belt are tightened with adjusters after straps are fastened.

Although these harnesses, if properly applied, will satisfy their intended purpose of lowering a person, if improperly applied, as sometimes happens, they can cause discomfort and injuries. Inasmuch as they are complex structures, they are difficult to store, are somewhat expensive, are subject to misuse and require substantial amounts of time to install, which during emergencies may be undesirable. Moreover, when used by the public they may be improperly applied.

SUMMARY OF THE INVENTION

It is a primary object of the present invention to provide a body harness which requires little, if any, training for use. It is a further object to provide a body harness which is easy to use. It is still yet another object to provide a body harness which can be installed in a minimum amount of time. It is still further an object to provide a body harness which is of moderate cost. A still further object is to provide a body harness which can be stored in a small space when the harness is not being used. A still further object is to provide a harness which can be used by workers as well as the public at large. A still further object is to provide a means in a body harness for storing a descender of the type disclosed in my co-pending application Ser. No. 10/279,616.

In a first aspect of the invention a body harness comprises a generally oval shaped vest sewn from a single piece of material, a pair of separable torso straps attached to the vest, a separable crotch strap attached to the vest and buckles for separating and connecting segments of the torso and crotch straps. Means are provided in the buckles for tightening the torso and crotch straps when the harness is worn by a person. The term "separable" as used herein is intended to refer to an article which is not intended to be separated during normal usage. In a second aspect of the invention, a pair of non-separable torso straps and a non-separable crotch strap are provided together with an adjuster for tightening the straps on a person.

In employing the teaching of the present invention, a plurality of alternate constructions can be adopted to achieve the desired objects and capabilities. In this disclosure, one preferred embodiment is described. However, the disclosed embodiment is intended as an example only and should not be considered as limiting the scope of the invention.

Further objects, features and benefits will be apparent by reference to the drawings and ensuing detailed description of a preferred embodiment which discloses the best mode contemplated in carrying out the invention. The exclusive rights which are claimed are set forth in the numbered claims following the detailed description of the preferred embodiment.

BRIEF DESCRIPTION OF THE DRAWINGS

The invention will be better understood and further objects, characterizing features, details and advantages thereof will appear more clearly with reference to the diagrammatic drawings illustrating a preferred embodiment of the invention by way of non-limiting example only.

DETAILED DESCRIPTION OF A PREFERRED EMBODIMENT

Figure 1:
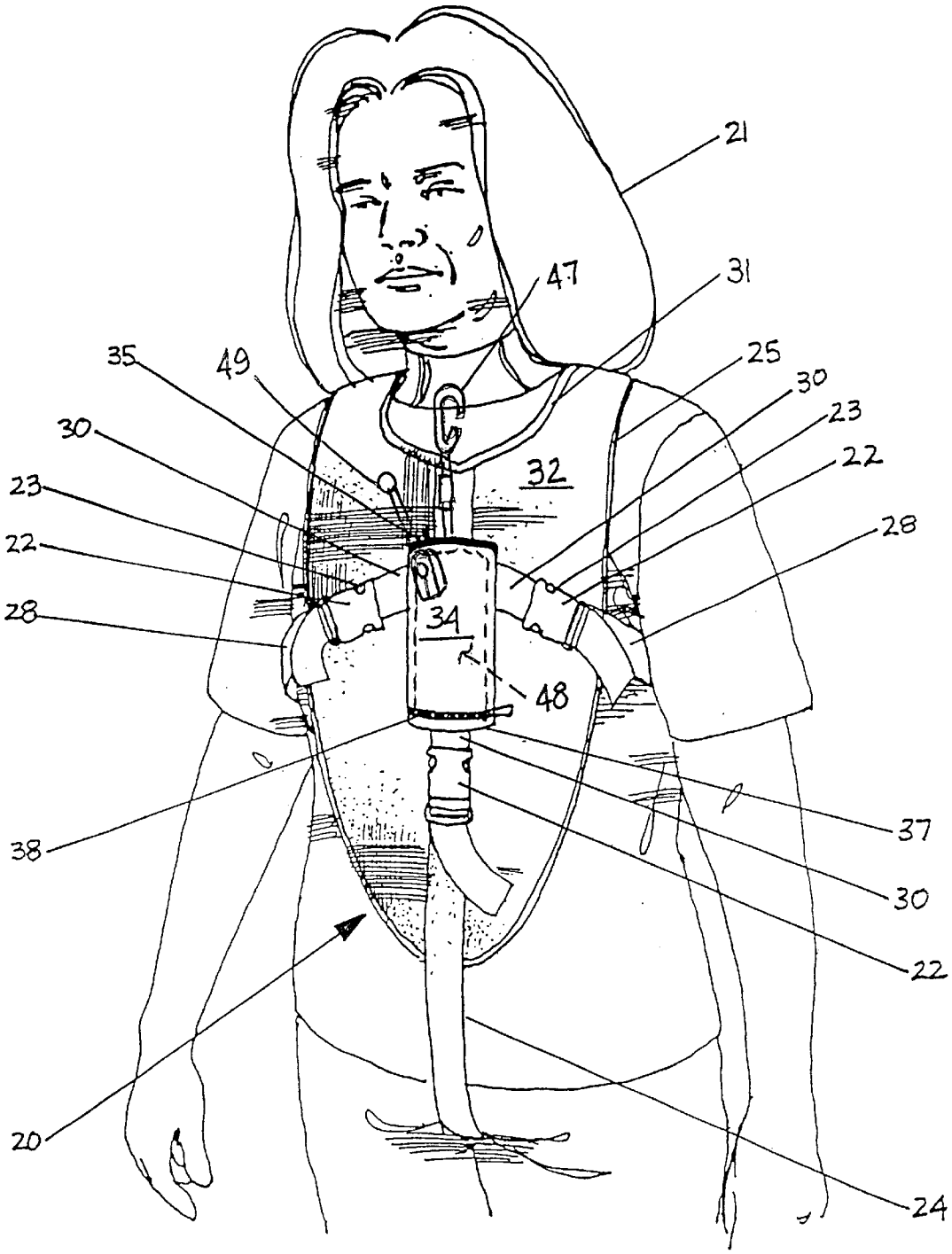
FIG. 1 is a perspective view showing the front and left side of a body harness as installed on a woman.

Referring now to the drawings wherein like numerals designate like and corresponding parts throughout the several views, a body harness, designated by the numeral 20 is shown with a person 21 according to the present invention.

One distinguishing feature of the harness 20 is that only three buckles 22 are used for mounting the harness 20 on the person 21. Another feature is that the buckles 22 are positioned on the chest in the view of the person 21. This feature allows the person 21 to easily buckle, adjust, and unbuckle the straps 23, 24 which retain the harness 20 and to observe whether the straps 23, 24 have been properly buckled. Another distinguishing feature of the harness is a closed cylindrical shaped pocket 34 on a front portion of the harness 20 for storing a descender and/or rope.

The harness 20 includes a substantially one-piece generally oval shaped vest 25 made of a suitable material such as nylon fabric, a pair of separable torso straps 23 attached to the vest 25, a separable crotch strap 24 attached to the vest 25, and the three quick-release buckles 22 for connecting and disconnecting portions of the straps 23, 24. The buckles 22 which divide each of the straps 23, 24 into long 28, 29 and short 30 portions are conventional and consist of male members 26 and companion female 27 members. Another distinguishing feature of the invention is an aperture 31 which divides the vest 25 into a chest portion 32 and a back portion 33.

Figure 3:
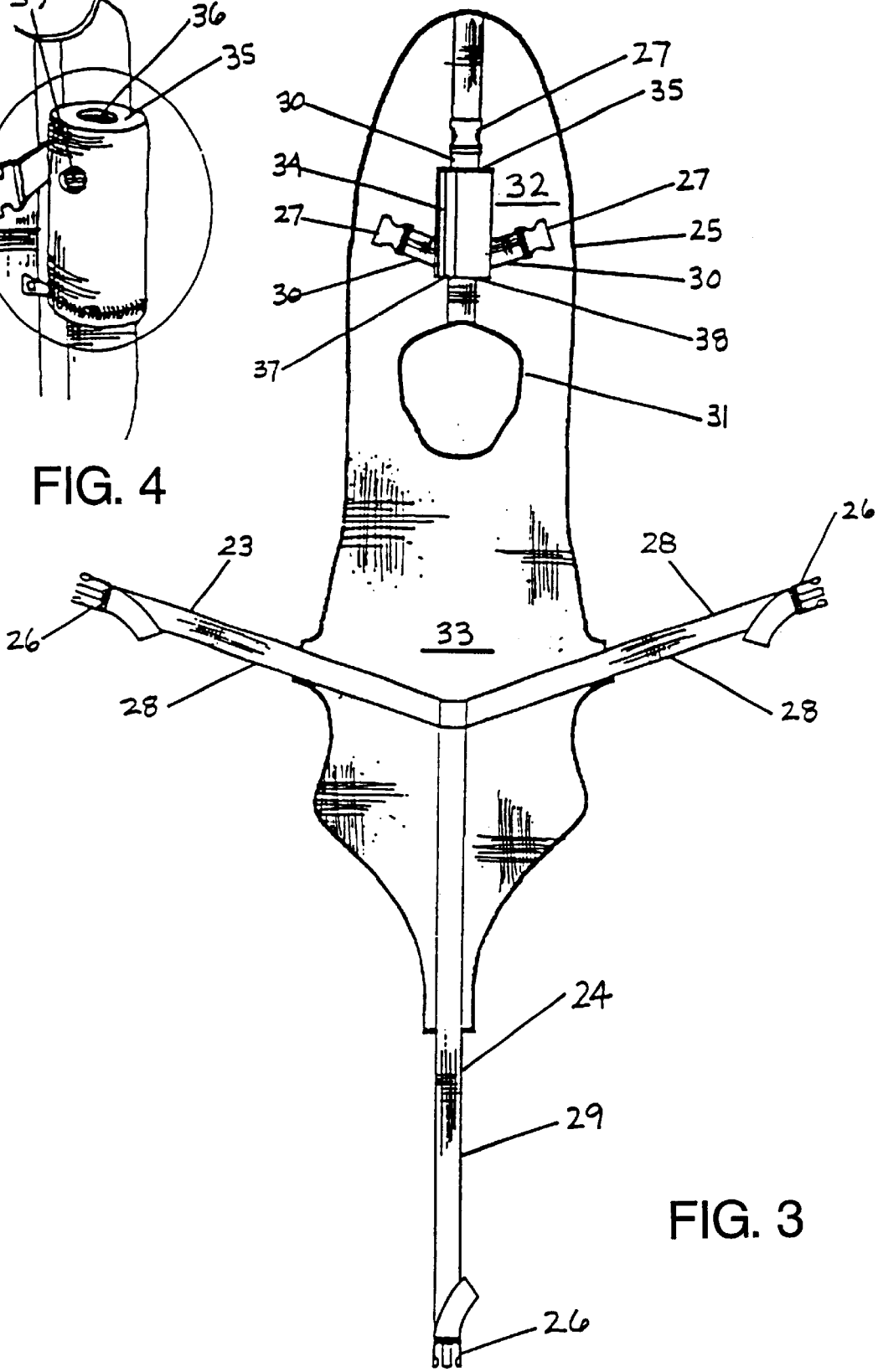
FIG. 3 is a plan view of the body harness.
Figure 5:
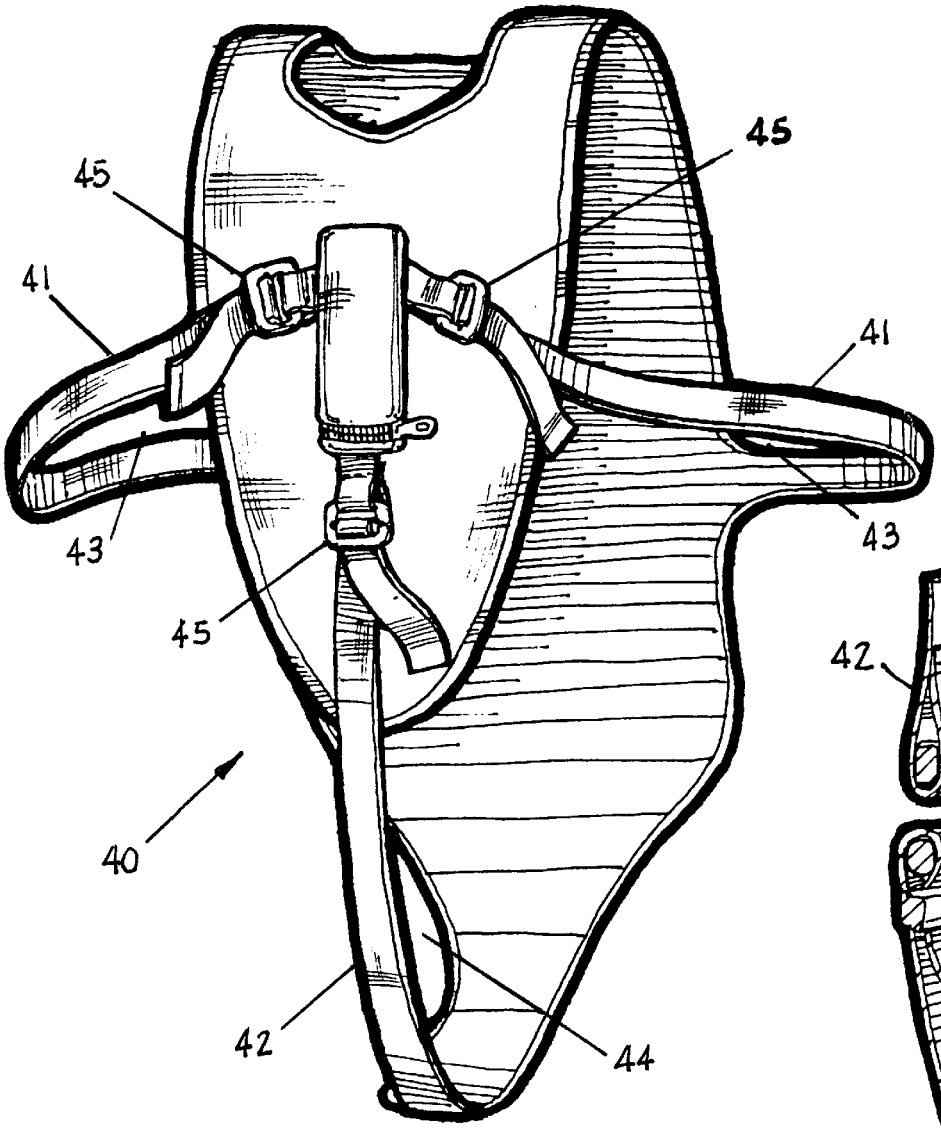
FIG. 5 is a perspective view of an alternate embodiment of the invention.
Figure 6:
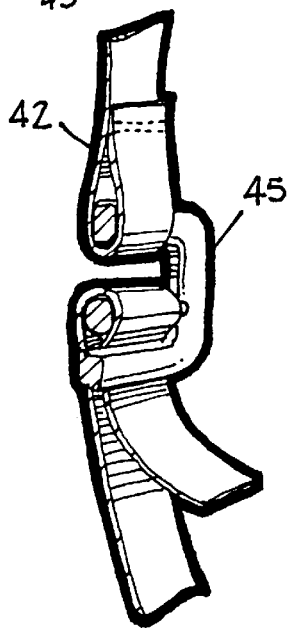
FIG. 6 is a partial perspective view of the alternate embodiment.

With reference to FIG. 3, the male members 26 of the buckles 22 are attached to ends of the long portions 28, 29 of the straps 23, 24 and the companion female members of the straps 23, 24 are attached to ends of the short portions 30 of the straps 23, 24. The lengths of the long portions 28, 29 of the straps 23, 24 are adjustable in the male members 26 of the buckles 22 for tightening the straps 23, 24 after the long 28, 29 and short portions 30 of the straps 23, 24 are connected by the buckles 22.

Figure 2:
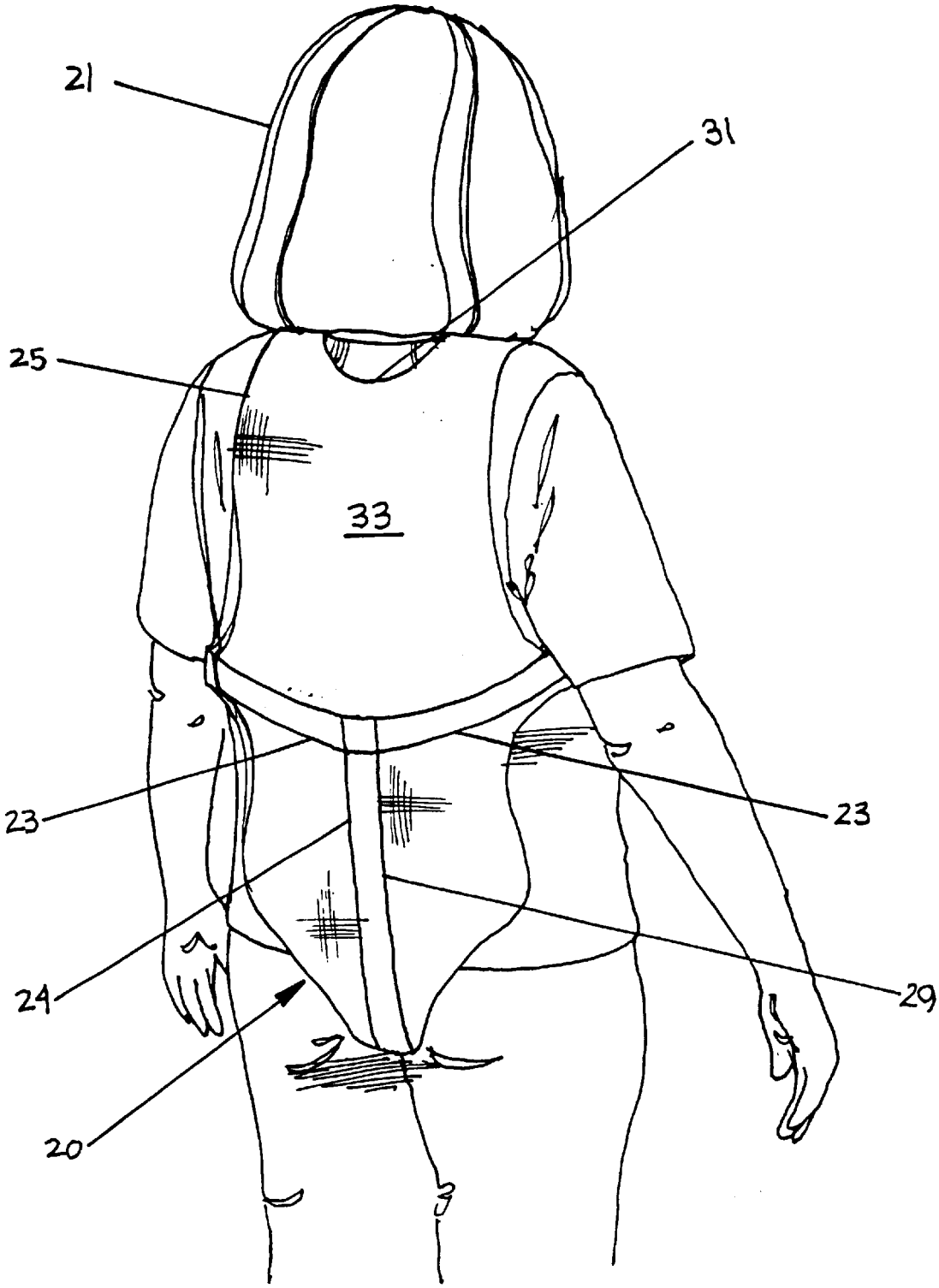
FIG. 2 is a perspective view showing the rear and right side of the body harness as installed.

In the orientation of FIGS. 1 and 2, the long portion 28 of each of the torso straps 23 are attached to the back portion 33 of the vest 25 and extend laterally and slightly upwardly to a point of attachment with a buckle 22 to the short portion 30 of the strap 23. The respective short portion 30 of the torso strap 23 is attached to the chest portion 32 of the vest 25 and extends laterally and slightly downwardly to the point of attachment with the long portion 28.

The long portion 29 of the crotch strap 24 is attached to the back portion of the vest 25 and extends vertically downwardly to a lowermost point of the harness 20 and then upwardly to a point of attachment with the short portion 30 of the crotch strap 24. The respective short portion 30 of the crotch strap 24 is attached to the chest portion 32 of the vest 25 and extends downwardly to the point of attachment with the long portion 29.

The vest 25 also includes on the chest portion 32 a closed cylindrical pocket 34 for storing a lifeline 47 and descender 48. In a top portion 35 and a right side portion of the pocket 34 are apertures 36 and 39 to accommodate portions of the descender. The aperture 36 in the top portion of the pocket 34 is for an end portion of the lifeline 47 which extends out of the pocket 34. The aperture 39 in the side of the pocket is for a control 49 which controls the rate of descent of a person wearing the vest 25. The bottom portion 37 of the pocket 34 is retained to the pocket 34 with a zipper 38 which allows access to the interior of the pocket 34 to install the descender 48.

The harness 20 shown in FIGS. 1–3 is mounted on a person 21 in the following manner. The harness 20 is positioned over the head of the person 21 and the vest 25 is then lowered on to the shoulders of the person 21 by passing the head of the person 21 through the aperture 31. The back 33 and chest 32 portions of the vest 25 are next placed against the back and chest, respectively, of the person 21. This is followed by placing of the long portions 28 of the torso straps 23 on the person's chest, connecting the long 28 and short 30 portions of torso straps 23 with their respective buckles 22 and removing slack by tightening the straps 23. Thereafter, the long portion 29 of the crotch strap 24 is brought forward between a person's legs and upward to the person's chest. The final steps are to connect the long 29 and short 30 portions of the crotch strap 24 with its buckle and to tighten the crotch strap against the abdomen and chest of the person 21.

Figure 4:
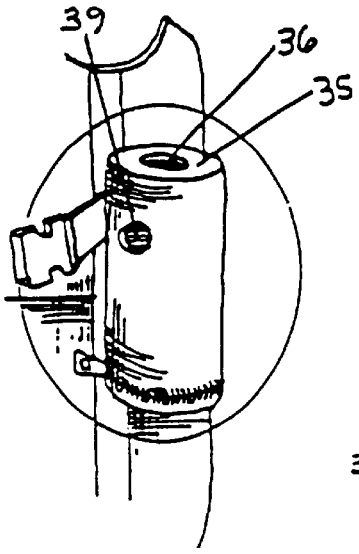
FIG. 4 is partial perspective view of the body harness.

An alternate embodiment 40 of the invention is shown in FIG. 4. In this embodiment 40 a pair of non-separable torso straps 41 and a non-separable crotch strap 42 are provided. At intermediate portions of the straps 40, 41, adjusters 45 are provided for tightening the straps on a person 21 after the harness 40 has been installed. One benefit of this embodiment 40 is it eliminates the possibility of product misuse. The straps 41, 42 extend between the back 33 and chest 32 portions of the vest 25 and form loops 43, 44 for embracing the torso and subtending the crotch of a person 21.

The alternate embodiment 40 is used in the following manner. A head of a person 21 is inserted through the aperture 31 in the vest 25 of the body harness 40. An arm is passed through a loop 43 of a torso strap 41 and a leg is passed through loop 44 of the crotch strap 42 to embrace a portion of the person's torso and subtend the person's crotch. The remaining portion of the person's torso is embraced by passing the person's other arm through the loop 43 of the remaining torso strap. Slack in each of the straps 40, 41 is removed by tightening the straps 41, 42 in the adjusters 45.

From the foregoing, it is apparent that the present invention provides an improved body harness for lowering persons from heights to relatively lower heights during emergencies as well as for the safety of tree trimmers, window washers, mountain climbers and construction workers. The improved body harness requires little, if any, training; is moderate in cost and is quick and easy to install. Moreover, a means is provided for storing a descender and/or a rope.

Although only a pair of embodiments have been described, it will be appreciated that other embodiments can be derived by obvious changes in shape as well as eliminations, substitutions, inversions, and re-arrangement of parts known to persons skilled in the art without departing from the spirit thereof.

What I claim is new is:

1. In combination with a descender apparatus for lowering a person from a height to a relatively lower height, a body harness comprising: a generally oval shaped vest made from substantially a single piece of material having an aperture for installing the harness over a head of a person, said aperture defining a back portion of said vest on one side of said aperture and a chest portion of said vest on an opposite side of said aperture; a pair of separable torso straps for embracing a torso of said person, each of said torso straps having a first portion attached to said back portion of said vest and a second portion attached to said chest portion of said vest; a separable crotch strap for subtending a crotch of said person, said crotch strap having a first portion attached to said back portion of said vest and a second portion attached to said chest portion of said vest; a pair of buckles for connecting said first and said second portions of said torso straps; and a third buckle for connecting said first and said second portions of said crotch strap; and a means on a front portion of said vest for enclosing said descender apparatus and withstanding the forces of said descender apparatus during said lowering of said person from said height.

2. The body harness recited in claim 1 wherein said means for enclosing said descender apparatus and withstanding said forces of said descender apparatus is a pocket on said chest portion for storing said descender apparatus and withstanding said forces of said descender apparatus during said lowering of said person.

3. A body harness for lowering a person from a height to a relatively lower height comprising: a generally oval shaped vest having an aperture for installing said harness over a head of a person, said aperture defining a back portion on one side of said aperture and a chest portion on an opposite side of said aperture; a pair of torso straps, each having separable portions extending laterally and slightly upwardly from an attachment to said back portion to an attachment on said chest portion; a crotch strap having separable portions extending vertically downwardly from an attachment to said back portion and then vertically upward an attachment on said chest portion; a quick opening buckle at an intermediate position in each of said torso straps for connecting and separating said separable portions of said torso straps; a quick opening buckle at an intermediate portion of said crotch strap for connecting and separating said separable portions of said crotch strap; and an enclosing means on said vest for enclosing a descender apparatus and withstanding the forces of said descender apparatus during said lowering of said person.

4. In combination with a descender apparatus, a body harness for lowering a person from a height to a relatively lower height comprising: a one piece generally oval shaped vest, said vest having a chest portion and an adjoining back portion; a pair of torso straps extending laterally and slightly upwardly from an attachment to said back portion to an attachment on said chest portion; a crotch strap extending vertically downwardly from an attachment to said back portion and then upwardly to an attachment on said chest portion; a quick opening buckle at an intermediate position in each of said torso straps for separating said torso and said crotch straps; and a pocket on said chest portion of said vest for enclosing said descender apparatus and sustaining the forces of said descender apparatus during said lowering of said person.

5. A body harness for lowering a person from a height to a relatively lower height comprising: a generally oval shaped vest made from substantially a single piece of material having an aperture for installing the harness over a head of a person, said aperture defining a back portion of said vest on one side of said aperture and a chest portion of said vest on an opposite side of said aperture; a pair of torso straps for embracing a torso of said person, each of said torso straps having a long portion attached to said back portion of said vest and a short portion attached to said chest portion of said vest; a crotch strap for subtending a crotch of said person, said crotch strap having a long portion attached to said back portion of said vest and a short portion attached to said chest portion of said vest; a means for connecting said long and said short portions of said torso straps; a means for connecting said long portion and said short portion of said crotch strap; and an enclosing means on said chest portion for attaching a descender apparatus and withstanding the forces of said descender apparatus during said lowering of said person.

6. The body harness recited in claim 5 wherein means for connecting said portions of said torso straps and said means for connecting said portions of said crotch strap are separable means.

7. The body harness recited in claim 5 wherein means for connecting said portions of said torso straps and said means for connecting said portions of said crotch strap are non-separable means.

8. A method for attaching a descender apparatus and a body harness to a person for lowering said person from a height to a relatively lower height comprising the steps of: enclosing said descender apparatus in a pocket of said body harness which is capable of withstanding the forces of said descender apparatus during said lowering of said person; inserting a head of said person through an aperture in a vest of said body harness; embracing a torso of said person with a pair of narrow torso straps, connecting end portions of said pair of torso straps with a pair of buckles; removing slack in said torso straps by tightening said torso straps around said torso; subtending a crotch of said person with a narrow crotch strap; connecting end portions of a crotch strap with a buckle; and removing slack in said crotch strap by tightening said torso strap around said crotch.

9. A method for attaching a descender apparatus and a body harness to a person comprising the steps of: enclosing said descender apparatus in a pocket of said body harness which is capable of withstanding the forces of said descender apparatus during said lowering of said person; inserting a head of said person through an aperture in a vest of said body harness; embracing a portion of a torso of said person with a first narrow torso strap by inserting an arm of said person through a loop of said first torso strap; subtending in a crotch of said person with a narrow crotch strap by passing a leg of said person through a loop of said crotch strap; embracing a remaining portion of said torso of said person with a second narrow torso strap by inserting another arm of said person through a loop of said second torso strap; removing slack in said first torso strap by tightening said first torso strap with an adjuster; removing slack in said second torso strap by tightening said second torso strap with a second adjuster; and removing slack in said crotch strap by tightening said crotch strap with a third adjuster.

10. In combination with a descender apparatus, a body harness in combination with a descender apparatus comprising a housing for coiling and storing a lifeline and a means for selectively controlling a rate of descent of a person from a height to a relatively lower height; said body harness comprising: a vest, said vest having a front portion for bearing against a chest portion of said person, a rear portion for bearing against a back portion of said person, and having an aperture for installing the harness over a head of a person, said aperture defining a back portion of said vest on one side of said aperture and a chest portion of said vest on an opposite side of said aperture; and a means on said chest portion for attaching a descender which is capable of withstanding the forces of said descender during a lowering of a person from a height.

* * * * *